US006314726B1

(12) United States Patent
Meyer et al.

(10) Patent No.: US 6,314,726 B1
(45) Date of Patent: Nov. 13, 2001

(54) APPARATUS AND METHOD FOR DRIVING A HYDRAULIC SYSTEM OF A CONSTRUCTION MACHINE, IN PARTICULAR A HYDRAULIC EXCAVATOR

(75) Inventors: Joachim Meyer, Langenfeld; Gerd Ehrich, Monheim, both of (DE)

(73) Assignee: Komatsu Mining Germany GmbH, Düsseldorf (DE)

( * ) Notice: Subject to any disclaimer, the term of this patent is extended or adjusted under 35 U.S.C. 154(b) by 0 days.

(21) Appl. No.: 09/519,835

(22) Filed: Mar. 6, 2000

(30) Foreign Application Priority Data

Mar. 4, 1999 (DE) ..... 199 11 440

(51) Int. Cl.[7] ..... F16D 31/02
(52) U.S. Cl. ..... 60/394; 60/421
(58) Field of Search ..... 60/421, 422, 424, 60/426, 486, 394

(56) References Cited

U.S. PATENT DOCUMENTS 4,369,625 * 1/1983 Izumi et al. ..... 60/422 X
5,029,067 * 7/1991 Nishida et al. ..... 60/421 X
5,365,737 * 11/1994 Moriya et al. ..... 60/469
5,950,428 * 9/1999 Nam et al. ..... 60/421

* cited by examiner

*Primary Examiner*—John E. Ryznic
(74) *Attorney, Agent, or Firm*—Cohen, Pontani, Lieberman & Pavane

(57) ABSTRACT

A method and an apparatus for driving a hydraulic system of a construction machine, in particular a hydraulic excavator, having a plurality of control blocks which are fed via at least one pump each and each drive a plurality of hydraulically operated actuators of the construction machine. At least two control blocks are designed to drive the same actuator. The delivery capacity of the pump of the second control block can be connected up to the actuator via a delay element.

5 Claims, 2 Drawing Sheets

APPARATUS AND METHOD FOR DRIVING A HYDRAULIC SYSTEM OF A CONSTRUCTION MACHINE, IN PARTICULAR A HYDRAULIC EXCAVATOR

BACKGROUND OF THE INVENTION

1. Field of the Invention

The invention relates to an apparatus and a method for driving a hydraulic system of a construction machine, in particular a hydraulic excavator.

2. Discussion of the Prior Art

As is generally known, the hydraulic system of a powerful hydraulic excavator has a plurality of control blocks fed via a pump each. Each control block is used to drive a plurality of hydraulic actuators. Thus, for example, a first control block can drive the working equipment as well as the right-hand running gear, a second control block can drive the working equipment as well as the left-hand running gear, a third control block can drive the working equipment as well as the slewing mechanism, and a fourth control block can drive the working equipment as well as, likewise, the slewing mechanism. This division of the pump output between the control blocks ensures the effective supply of the various hydraulic actuators with pressure medium.

Since it is customary for the slewing mechanism to be switched on only for about 25% of a working cycle, here the pump of the slewing mechanism circuit can also be used for the working equipment circuit. When the movement of the slewing mechanism is initiated, however, the quantity delivered by the pump is concentrated onto the slewing mechanism circuit. As a result of this, it is no longer available to the working equipment circuit, in particular the boom cylinder. On the other hand, a major part of the available quantity delivered by the pump is only needed at the end of the acceleration phase of the slewing unit, since at the beginning of the acceleration phase it is a high torque (pump pressure) at a low speed (pump delivery quantity) which is preferentially needed. Only when the angular speed of the slewing mechanism superstructure rises does the requirement on the quantity delivered by the pump rise accordingly, the ultimate consequence of which is that as the angular speed of the superstructure rises, a slowing down of the movement of the working equipment, in particular the boom, occurs.

SUMMARY OF THE INVENTION

It is therefore an object of the present invention to reduce the impairment to the performance of a hydraulic system of the type mentioned above.

In a hydraulic system in which at least two control blocks are designed to drive the same actuator, the invention includes the technical teaching of connecting up the delivery capacity of the pump of the second control block to the actuator via a delay element.

It is preferred if this drive is used for the hydraulic slewing mechanism motor as an actuator. By contrast with switching on both pumps simultaneously for the slewing movement of the superstructure, initially only one pump is used in order to accelerate the superstructure out of the rest position. Since the requirement for pressure medium rises with increasing angular speed, the second pump is connected up only when the first pump reaches its delivery limit. Up to this point, the second pump is still completely available to the other actuators which can be driven by the control block assigned to it. Overall, switching on with a delay reduces the impairment to the performance of a hydraulic system of the type specified at the beginning.

Switching on the second pump with a delay can be implemented in accordance with three preferred alternatives. Firstly, the delay element can be constructed in the manner of a time relay which connects up the pump of the second control block after the expiration of a permanently predefinable time period. In this case, the predefinable time period has to be determined and optimized by trials. Secondly, the delay element can contain a sensor element which registers the speed of the actuator and whose output data is processed by an electronic unit which connects up the pump of the second control block when the final speed of the actuator is reached. As the third alternative, it is possible for the delay element to comprise a sensor element which determines the pressure in the hydraulic circuit of the actuator and whose output data is processed by an electronic unit which connects up the pump of the second control block at a pressure drop which occurs after the acceleration phase of the actuator. In the case of the two alternative embodiments mentioned last, the final speed or the pressure drop are those events on the basis of which the demand for additional pump capacity is indicated. As a result of the second pump being connected up, the actuator experiences an additional acceleration thrust which is suitable at the time of the demand, so that the stewing mechanism as a whole can be positioned rapidly and, at the same time, minimum impairment occurs to the supply to other actuators to be driven via the same control block.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

The hydraulic system of a hydraulic excavator comprises a total of four control blocks 1*a* to 1*d*. Each control block 1*a* to 1*d* is supplied with pressure medium by means of an associated hydraulic pump 2*a* to 2*d*. The first control block 1*a* controls the right-hand side of the running gear and the bucket, dipper and boom components of the working equipment. The second control block 1*b* controls the left-hand side of the running gear and, likewise, the bucket, dipper and boom components of the working equipment. The third control block 1*c* controls the slewing mechanism and the boom and bucket components of the working equipment. The fourth control block 1*d* is responsible for driving the dipper and the boom of the working equipment and, likewise, for driving the slewing mechanism. The fourth control block 1*d* is additionally assigned a delay element 3 which is assigned to the slewing mechanism circuit. Via the delay element 3 it is possible to make the delivery capacity of the pump 2*d* associated with the control block 1*d* available to the slewing mechanism circuit. As a result of this, the delivery capacity of the pump 2*c* of the third control block 1*c* is fully exhausted first for moving the slewing mechanism before the second pump 2*d* is additionally used for this purpose.

Figure 1:
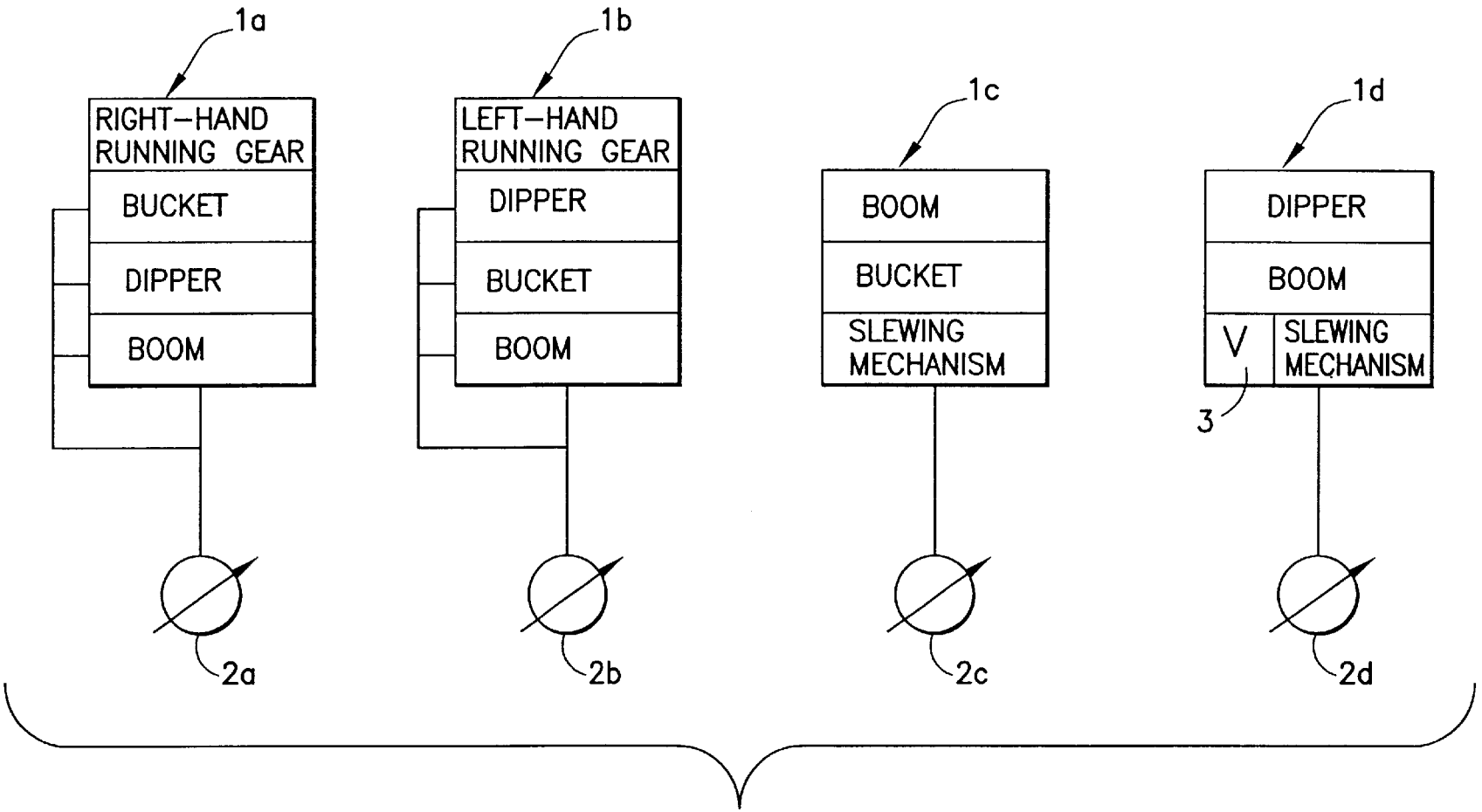
FIG. 1 shows a connection diagram of a hydraulic system of a hydraulic excavator.
Figure 2A:
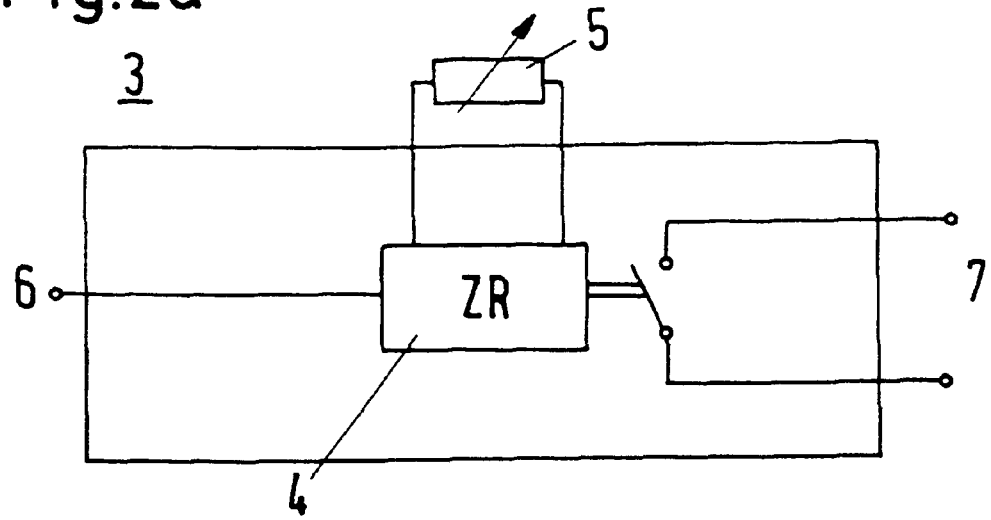
FIG. 2*a* shows a detailed representation of a delay element with a time-controlled connection.

The delay element 3 can contain a time relay 4 according to FIG. 2*a*. The time relay 4 has a setting element 5 with which the delay time period can be set manually. If, then, the switch-on signal for the slewing mechanism comes into the delay element 3 via the input 6, this signal is connected through to the output 7 by the time relay 4 only after the expiration of the time period defined via the setting element 5.

Figure 2B:
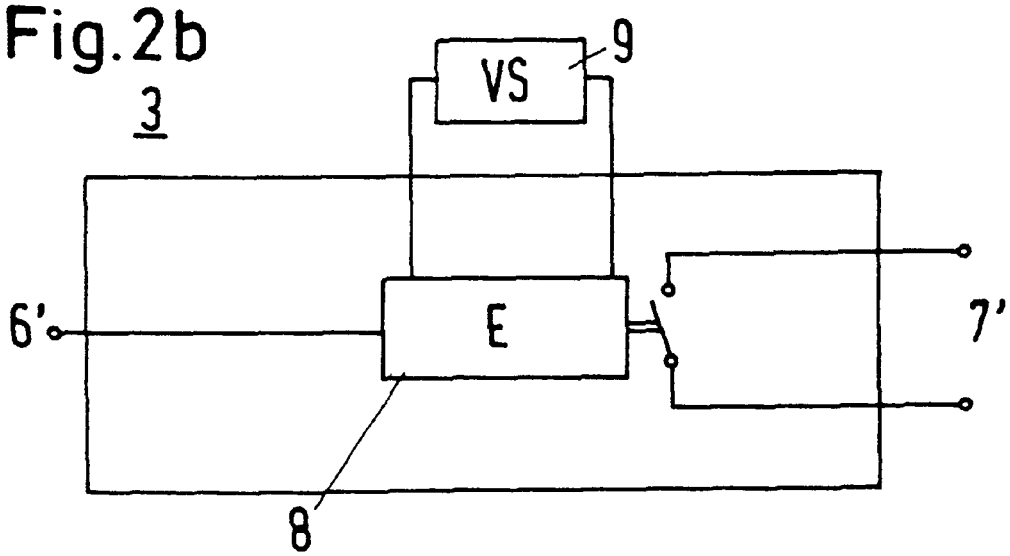
FIG. 2*b* shows a detailed representation of a delay element with a final-speed-controlled connection.

According to FIG. 2*b*, the delay element 3 can also be constructed from an electronic unit 8, whose input is connected to a speed sensor 9. The speed sensor 9 registers the current angular speed of the slewing mechanism. The switch-on signal for the slewing mechanism, which is fed to the input 6' is switched through to the output 7' only when the electronic unit 8 registers a value lying within the range of the final speed of the slewing mechanism during the acceleration phase.

Figure 2C:
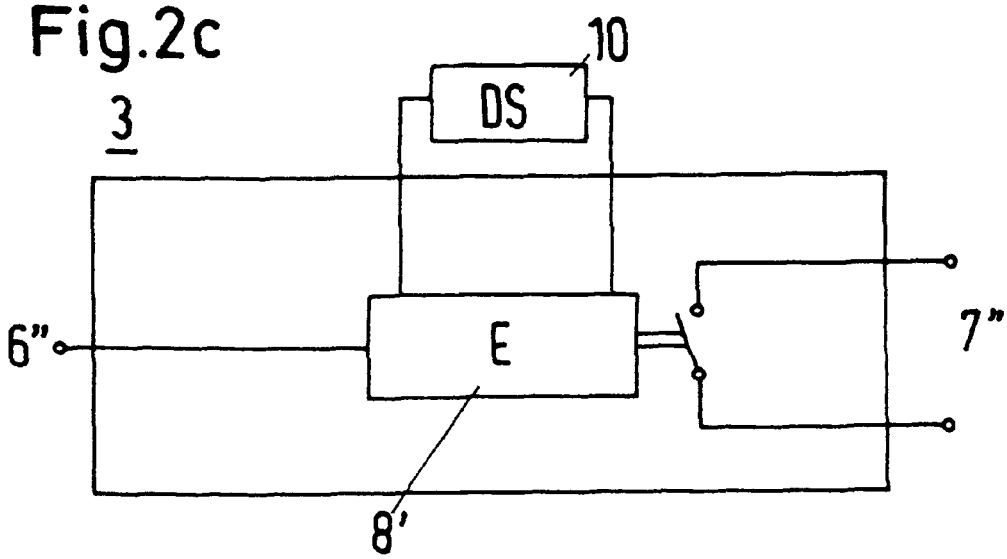
FIG. 2*c* shows a detailed representation of a delay element with a pressure-drop-controlled connection.

According to FIG. 2*c*, the delay element 3, as an alternative to the two previous embodiments, contains an electronic unit 8', which accepts the signals of a pressure sensor 10 on the input side. The pressure sensor 10 registers the current pressure in the slewing mechanism circuit. At the end of the acceleration phase effected by the pump 2*c*, a pressure drop occurs in the slewing mechanism circuit. This event is registered by the electronic unit 8', in order to switch through to the output 7" the switch-on signal from the slewing mechanism which is present on the inlet 6" and, to this extent, to connect up the pump 2*d* to the slewing mechanism with a delay.

The implementation of the invention is not restricted to the preferred exemplary embodiments indicated above. Instead, a number of variants are conceivable which make use of the solution illustrated, even in the case of designs of fundamentally different type.

We claim:

1. An apparatus for driving a hydraulic system of a construction machine, comprising: a plurality of control blocks which are fed via at least one pump each and are each operative to drive a plurality of hydraulically operated actuators of the construction machine, at least two of the control blocks being designed to drive a common actuator; and delay means for connecting delivery capacity of the pump of a second of the two control blocks to the common actuator after a delay, the delay means including a sensor element which registers actuator speed and outputs corresponding data to an electronic processor unit which connects the pump of the second control block when a final speed of the actuator is reached.

2. A method of driving a hydraulic system of a construction machine having a plurality of control blocks, comprising the steps of: feeding pressure medium via a respective pump to each control block, a plurality of hydraulically operated actuators being driven via each control block; driving at least one actuator via two of the control blocks; and connecting the pressure medium delivery capacity of the pump of a second of the control blocks driving the one actuator to the one actuator with a delay, including measuring actuator speed and connecting the pump of the second control block to the actuator with a delay so that the pump of the second control block is connected to the actuator only when a final speed of the actuator is reached.

3. An apparatus for driving a hydraulic system of a construction machine, comprising: a plurality of control blocks which are fed via at least one pump each and are each operative to drive a plurality of hydraulically operated actuators of the construction machine, at least two of the control blocks being designed to drive a common actuator; and delay means for connecting delivery capacity of the pump of a second of the two control blocks to the common actuator after a delay, the delay means including a sensor element which determines pressure in a hydraulic circuit of the actuator and outputs corresponding data to an electronic processor unit which connects the pump of the second control block at a pressure drop which occurs after an acceleration phase of the actuator.

4. An apparatus for driving a hydraulic system of a construction machine, comprising: a plurality of control blocks which are fed via at least one pump each and are each operative to drive a plurality of hydraulically operated actuators of the construction machine, at least two of the control blocks being designed to drive a common actuator; and delay means for connecting delivery capacity of the pump of a second of the two control blocks to the common actuator after a delay, the actuator being a hydraulic slewing mechanism motor.

5. An apparatus for driving a hydraulic system of a construction machine, comprising: a plurality of control blocks which are fed via at least one pump each and are each operative to drive a plurality of hydraulically operated actuators of the construction machine, at least two of the control blocks being designed to drive a common actuator; and delay means for connecting delivery capacity of the pump of a second of the two control blocks to the common actuator after a delay, the plurality of control blocks including at least four control blocks having a pump each, a first of the control blocks being operative to drive working equipment and a right-hand side of a running gear of the machine, a second of the control blocks being operative to drive the working equipment and a left-hand side of the running gear, a third of the control blocks being operative to drive the working equipment and a slewing mechanism of the machine, and a fourth of the control blocks being operative to drive the working equipment and the slewing mechanism, one of the pumps assigned to the third and fourth control blocks being connectable to the stewing mechanism via the delay means.

* * * * *